US008989998B2

(12) United States Patent
Le et al.

(10) Patent No.: US 8,989,998 B2
(45) Date of Patent: Mar. 24, 2015

(54) PREDICTED POSITION AND HEADING/TRACK INDICATORS FOR NAVIGATION DISPLAY

(71) Applicant: The Boeing Company, Chicago, IL (US)

(72) Inventors: Minh-Tri Le, Lynnwood, WA (US); Syed Tahir Shafaat, Everett, WA (US); Kim A. Nguyen, Everett, WA (US)

(73) Assignee: The Boeing Company, Chicago, IL (US)

( * ) Notice: Subject to any disclaimer, the term of this patent is extended or adjusted under 35 U.S.C. 154(b) by 121 days.

(21) Appl. No.: 13/851,558

(22) Filed: Mar. 27, 2013

(65) Prior Publication Data

US 2014/0297169 A1 Oct. 2, 2014

(51) Int. Cl.
*G08G 5/04* (2006.01)
*G08G 5/00* (2006.01)

(52) U.S. Cl.
CPC ..... *G08G 5/0021* (2013.01); *G08G 5/0052* (2013.01); *G08G 5/04* (2013.01); *G08G 5/0008* (2013.01)
USPC ..... 701/120; 701/4; 701/14; 701/300; 701/301; 342/29; 342/30

(58) Field of Classification Search
CPC .... G01S 13/9303; G08G 5/0078; G08G 5/04; G08G 5/045; G08G 5/0008
USPC ..... 701/3–14, 300, 301, 120; 342/29, 30
See application file for complete search history.

(56) References Cited

U.S. PATENT DOCUMENTS

| | | | | |
|---|---|---|---|---|
| 6,972,696 | B2 * | 12/2005 | Rogers et al. | 340/971 |
| 7,835,866 | B2 * | 11/2010 | Tzidon | 701/301 |
| 8,041,504 | B2 | 10/2011 | Shafaat et al. | |
| 8,089,375 | B1 * | 1/2012 | Seah | 340/971 |
| 8,744,738 | B2 * | 6/2014 | Bushnell | 701/122 |
| 8,830,090 | B2 * | 9/2014 | Shafaat | 340/979 |
| 2007/0222665 | A1 * | 9/2007 | Koeneman | 342/29 |
| 2009/0012660 | A1 * | 1/2009 | Roberts et al. | 701/3 |

(Continued)

FOREIGN PATENT DOCUMENTS

WO 2011107956 A1 9/2011

OTHER PUBLICATIONS

Extended European Search Report dated Oct. 15, 2014, European Patent Application No. 14156798.2 (European counterpart of the instant patent application).

*Primary Examiner* — Thomas G Black
*Assistant Examiner* — Sara Nelson
(74) *Attorney, Agent, or Firm* — Ostrager Chong Flaherty & Broitman P.C.

(57) ABSTRACT

A visual/graphical air traffic display tool to aid flight crews in determining future heading/track and position of ownship based on current climb rate, bank angle and groundspeed under current meteorological conditions. The tool displays symbols which indicate the predicted future position and heading/track of ownship on a traffic display unit. The tool is also capable of using ownship's predicted position and information received from surrounding traffic to identify a future conflict at ownship's predicted position and then display a future conflict warning on the traffic display unit. In one embodiment, the future conflict warning takes the form of a change in the coloration of the ownship position and heading/track indicator being displayed.

22 Claims, 4 Drawing Sheets

(56) References Cited

U.S. PATENT DOCUMENTS

| | | | | |
|---|---|---|---|---|
| 2009/0027253 | A1* | 1/2009 | van Tooren et al. | 342/29 |
| 2009/0112535 | A1* | 4/2009 | Phillips | 703/2 |
| 2009/0219197 | A1* | 9/2009 | Bunch | 342/26 B |
| 2010/0060511 | A1* | 3/2010 | Nouvel et al. | 342/29 |
| 2010/0292871 | A1* | 11/2010 | Schultz et al. | 701/3 |
| 2011/0125399 | A1* | 5/2011 | Clark et al. | 701/208 |
| 2011/0224847 | A1* | 9/2011 | Singer et al. | 701/4 |
| 2013/0009792 | A1 | 1/2013 | Shafaat | |
| 2014/0210648 | A1* | 7/2014 | Samuthirapandian et al. | 340/961 |
| 2014/0303883 | A1* | 10/2014 | Aso et al. | 701/300 |

m

* cited by examiner

PREDICTED POSITION AND HEADING/TRACK INDICATORS FOR NAVIGATION DISPLAY

BACKGROUND

The invention generally relates to systems and methods for displaying traffic information on a display unit. In particular, the disclosed embodiments relate to systems and methods for displaying air traffic on a traffic display unit, such as a navigation display located in the cockpit or on the flight deck of an aircraft.

The term "traffic display unit" will be used hereinafter to refer to display units that display symbols representing vehicular traffic of interest to a display unit viewer. Thus the term "traffic display unit", as used herein, includes navigation displays and other types of traffic display units onboard aircraft.

Modern aircraft typically include cockpit displays that are controlled by an information system. Cockpit displays include the basic displays that are supplied with the aircraft, and other add-on displays which vary in their degree of integration with the physical aircraft structure and aircraft systems. In a modern electronic cockpit, the flight instruments typically include a so-called "navigation display". A navigation display (which may be adjacent to the primary flight display) along with navigational information may show the current position of all aircraft within the display range and information. Current implementations of a navigation display range selection are typically in whole number increments (for example, 640, 320, 160, 80, 40, 20, and 10 nautical mile ranges) such that intermediate display range selections between the whole number increments are not utilized.

On existing navigation displays onboard many aircraft, the flight crew does not know if other airplanes represented by non-directional symbols on the display are turning or going straight. The flight crew has limited information about airplane traffic and has to monitor the traffic to determine its direction of travel.

Many modern aircraft are equipped with a traffic collision avoidance system (TCAS) which monitors the surrounding airspace for similarly TCAS-equipped aircraft, independent of air traffic control, and issues an alert when a conflict (i.e., a potential collision threat) with another aircraft is identified. (The term "conflict" as used herein is an event in which two aircraft experience a loss of minimum separation. A conflict occurs when the distance between aircraft in flight violates a defining criterion, usually a minimum horizontal and/or minimum vertical separation. These distances define an aircraft's protected zone, a volume of airspace surrounding the aircraft which should not be infringed upon by any other aircraft.) Each TCAS-equipped aircraft interrogates all other aircraft in a specified range, and all other aircraft reply to the interrogations which they receive. The TCAS comprises a processor, a directional antenna mounted on the top of the aircraft, an omnidirectional or directional antenna mounted on the bottom of the aircraft, and a traffic display in the cockpit. The TCAS traffic display may be integrated into the navigation display or some other cockpit display. The TCAS processor builds a three-dimensional map of aircraft in the airspace, incorporating their range, closure rate, altitude and bearing; then the TCAS processor determines if a conflict exists by extrapolating current range and altitude difference to anticipated future values and determining whether another aircraft has entered a protected volume of airspace that surrounds ownship. The extent of the protected volume of airspace will depend on the altitude, groundspeed and heading/track of the aircraft involved in the encounter.

More specifically, the TCAS processor executes a program that performs a conflict detection algorithm. Based on parameters applied by the conflict detection algorithm, the TCAS gives an alert when several conditions occur: (1) Entry by an intruder into a protected airspace (called the Traffic Advisory region) surrounding the ownship causes the TCAS onboard that aircraft to issue a Traffic Advisory (hereinafter "TA"). (2) If the opposing traffic is within the protected airspace and the TCAS detects that the heading/track, climb rate, and closure rate of the opposing traffic may cause it to collide with the ownship; the TCAS issues a Resolution Advisory (hereinafter "RA").

In addition, a significant number of aircraft flying today are also equipped with the Automatic Dependent Surveillance-Broadcast (ADS-B) system and by year 2020 all aircraft operating within the airspace of the United States must be equipped with some form of ADS-B. The ADS-B system enhances safety by making an aircraft visible in real-time to air traffic control and to other suitably equipped aircraft. The ADS-B technology enhances safety by enabling display of traffic positions and other data, in real-time, to Air Traffic Control (ATC) and to other appropriately equipped ADS-B aircraft, with position (i.e., latitude, longitude and altitude), velocity (i.e., groundspeed) and other data being transmitted every second. Using this information, a traffic processor onboard a receiving aircraft can calculate the current heading/track and a future position of a transmitting aircraft. When using an ADS-B system, a pilot is able to receive traffic information about aircraft in his vicinity and at farther distances. The ADS-B system relies on two avionics components—a high-integrity GPS navigation source and a data link (ADS-B unit) connected to other aircraft systems. ADS-B enables cockpit display of traffic information for surrounding aircraft, including the identification, position, altitude, heading/track and groundspeed of those aircraft. With the use of ADS-B traffic, the flight crew is given more information about traffic heading/track, groundspeed and position. Using that information, the flight crew must perform monitoring tasks to keep track of traffic in their vicinity and then estimate whether traffic may cross their path in the future or cause a TA/RA conflict in the future.

However, current implementations of navigation display on a typical commercial aircraft do not give any indication of the predicted future position of ownship. There are no visual indications to the flight crew of where the aircraft will be at any given point of time in the future. Therefore, flight crews typically make estimates of their future location without support of navigational aids.

Furthermore, current traffic display implementation is reactive to ownship position versus external traffic conditions. It reacts only to the current situation and does not provide enough situational awareness to the flight crew to indicate future TA/RA conflicts based on current maneuvering.

Accordingly, there is a need for electronic traffic display units that can indicate future TA/RA conflicts based on current maneuvering. In particular, it is desirable that electronic traffic display units be able to display easily interpretable symbols indicating future positions of ownship so that conflicts with air traffic can be anticipated by the pilot.

SUMMARY

The subject matter disclosed herein is directed to a visual/graphical air traffic display tool to aid flight crews in determining future heading or track (i.e., track angle) and position of ownship based on current position, current heading or track (hereinafter "heading/track"), current bank angle and current groundspeed under current meteorological conditions. When used in conjunction with a traffic collision avoidance system, this tool can be used for predicting future traffic conflict and allows for proactive avoidance maneuvers by ownship's pilot prior to the triggering of a TCAS traffic advisory. The tool displays symbols which indicate the predicted future position and heading/track of ownship on a traffic display unit. The tool is also capable of using ownship's predicted position and information received from surrounding traffic to identify a future conflict at ownship's predicted position and display a future conflict warning on the traffic display unit. In one embodiment, the future conflict warning takes the form of a change in the coloration of the future position and heading/track indicator (e.g., an oriented ownship symbol) being displayed; as an example, coloration change may be a transition to a color such as amber or red.

One aspect of the subject matter disclosed in detail below is a method for displaying traffic information on a traffic display unit onboard a first aircraft, comprising: acquiring data representing a current position, current climb rate, current groundspeed, current heading/track, and current bank angle of the first aircraft; calculating a future position and a future heading/track of the first aircraft that would result were the first aircraft to continue to fly from its current position at its current climb rate, current groundspeed and current bank angle for a specified time or distance; displaying a first symbol that indicates the current position and current heading/track of the first aircraft relative to a frame of reference; and displaying a second symbol that indicates the future position and future heading/track of the first aircraft relative to the frame of reference.

In accordance with a further aspect, the aforementioned traffic information display method may further comprise: intermittently receiving data from a second aircraft during a period of time, the received data representing respective positions and groundspeeds of the second aircraft at successive times during the period of time; and displaying a third symbol that indicates a current position of the second aircraft relative to the frame of reference.

In accordance with a further aspect, the aforementioned traffic information display method may further comprise: (a) calculating a future position of the second aircraft that would result were the second aircraft to continue to fly from its current position with its current heading/track, current climb rate and current groundspeed for the specified time or the time it will take for the first aircraft to fly the specified distance; (b) determining whether there would be a conflict between the first and second aircraft where the first and second aircraft located at the respective calculated future positions; and (c) modifying the displayed traffic information to produce a first visible effect in response to a determination that there would be a conflict between the first and second aircraft if they were located at the respective calculated future positions.

In accordance with yet another aspect, the aforementioned traffic information display method may further comprise: determining whether a loss of separation between the first and second aircraft will occur were the first and second aircraft to continue on their respective predicted flight paths after reaching the respective calculated future positions; and modifying the displayed traffic information to produce a second visible effect different than the first visible effect in response to a determination that a loss of separation will occur.

Further aspects of the below-disclosed subject matter include a system for displaying traffic information, comprising a display screen and a computer system programmed to perform the operations set forth in the three preceding paragraphs.

Another aspect is a method for generating a traffic alert onboard a first aircraft, comprising: acquiring data representing a current position, current climb rate, current groundspeed, current heading and track, and current bank angle of the first aircraft; calculating a future position and a future heading/track of the first aircraft that would result were the first aircraft to continue to fly from its current position at its current climb rate, current groundspeed and current bank angle for a specified time or distance; intermittently receiving data from a second aircraft during a period of time preceding a current time, the received data representing respective positions and groundspeeds of the second aircraft at successive times during the period of time; calculating a future position of the second aircraft that would result were the second aircraft to continue to fly from its current position with its current heading/track, current climb rate and current groundspeed for the specified time or the time it will take for the first aircraft to fly the specified distance; and determining whether there would be a conflict between the first and second aircraft were the first and second aircraft located at the respective calculated future positions. This method may further comprise determining whether a loss of separation between the first and second aircraft will occur were the first and second aircraft to continue on their respective predicted flight paths after reaching the respective calculated future positions. Optionally, a first visible or audible effect is produced in response to a determination that there would be a conflict between the first and second aircraft if they were located at the respective calculated future positions; and a second visible or audible effect is produced in response to a determination that a loss of separation will occur.

Yet another aspect is a system for generating a traffic alert onboard a first aircraft, comprising: a source of data representing the position, climb rate, track, groundspeed and bank angle of the first aircraft at successive times during a time period; an antenna capable of receiving TCAS messages and ADS-B messages from other aircraft during the time period; a traffic processor programmed to derive first data representing the ranges, altitudes and bearings of other aircraft from received TCAS messages and further programmed to derive second data representing the positions and groundspeeds of other aircraft from received ADS-B messages; a warning device capable of producing a visual or audible alert in response to an alert activation command; and a conflict processor programmed to perform the following operations: (a) calculate a future position and a future heading/track of the first aircraft that would result were the first aircraft to continue to fly from its current position at its current climb rate, current groundspeed and current bank angle for a specified time or distance; (b) calculate a future position of the second aircraft that would result were the second aircraft to continue to fly from its current position with its current heading/track and at its current climb rate and current groundspeed for the specified time or the time it will take for the first aircraft to fly the specified distance; (c) detect whether the second aircraft has intruded into a first specified volume of airspace surrounding the current position of the first aircraft; (d) determine whether the second aircraft will intrude into a second specified volume of airspace surrounding the future position of the first aircraft; (e) send a first alert activation command to the warning device in response to detection of an intrusion by the second aircraft into the first specified volume of space at a current time; and (f) send a second alert activation command to the warning device in response to a determination that the second aircraft will intrude into the second specified volume at a future time.

Other aspects are disclosed in detail and claimed below.

BRIEF DESCRIPTION OF THE DRAWINGS

Reference will hereinafter be made to the drawings in which similar elements in different drawings bear the same reference numerals.

DETAILED DESCRIPTION

Embodiments of systems and methods for displaying traffic information on a traffic display unit onboard an aircraft (also referred to herein as "ownship") are disclosed below. The displayed traffic information may include the current and future positions of ownship and the current positions of TCAS and ADS-B traffic in the vicinity of ownship. The position and orientation of symbols representing other aircraft are a function of parametric information broadcast by those aircraft and processed by a computer system onboard ownship that controls the traffic display unit. In the particular examples disclosed herein, the traffic display unit is a navigation display or any other display unit in the flight deck where air traffic is displayed on an aircraft.

As disclosed above, ADS-B is a surveillance technology for tracking aircraft. The embodiments disclosed herein take advantage of the ADS-B technology to extrapolate the future positions of all in-range aircraft of interest. The time interval for extrapolating the future positions of aircraft traffic can be set by the flight crew or can be a default value used by ownship's navigation system depending upon the traffic environment or phase of flight or airspace region.

A specific example of a known traffic display unit will now be described with reference to FIG. 1, which shows a screen of a cockpit navigation display unit that is displaying symbols indicating the current positions of a TCAS-equipped ownship and other aircraft (in this example, a single TCAS-equipped aircraft) of potential interest to ownship's flight crew. The isosceles triangle 2 (hereinafter "ownship icon 2") in the middle and near the bottom of the screen represents the current position of ownship, while a trend vector 4 comprising three equally spaced line segments 4 represents the path or track that ownship will travel during the next future predefined interval of time (in this case, it is 90 seconds). The dashed curved line extending from the vertex of ownship icon 2 is a well-known means of indicating the planned or desired path or track of ownship. As will be readily appreciated by persons skilled in the art of cockpit displays, as ownship moves relative to Earth, the position of ownship icon 2 (which represents ownship) on the display screen seen in FIG. 1 will not change, but rather any symbols representing waypoints (none appear in FIG. 1) and other symbols representing stationary landmarks will move relative to ownship icon 2.

Figure 1:
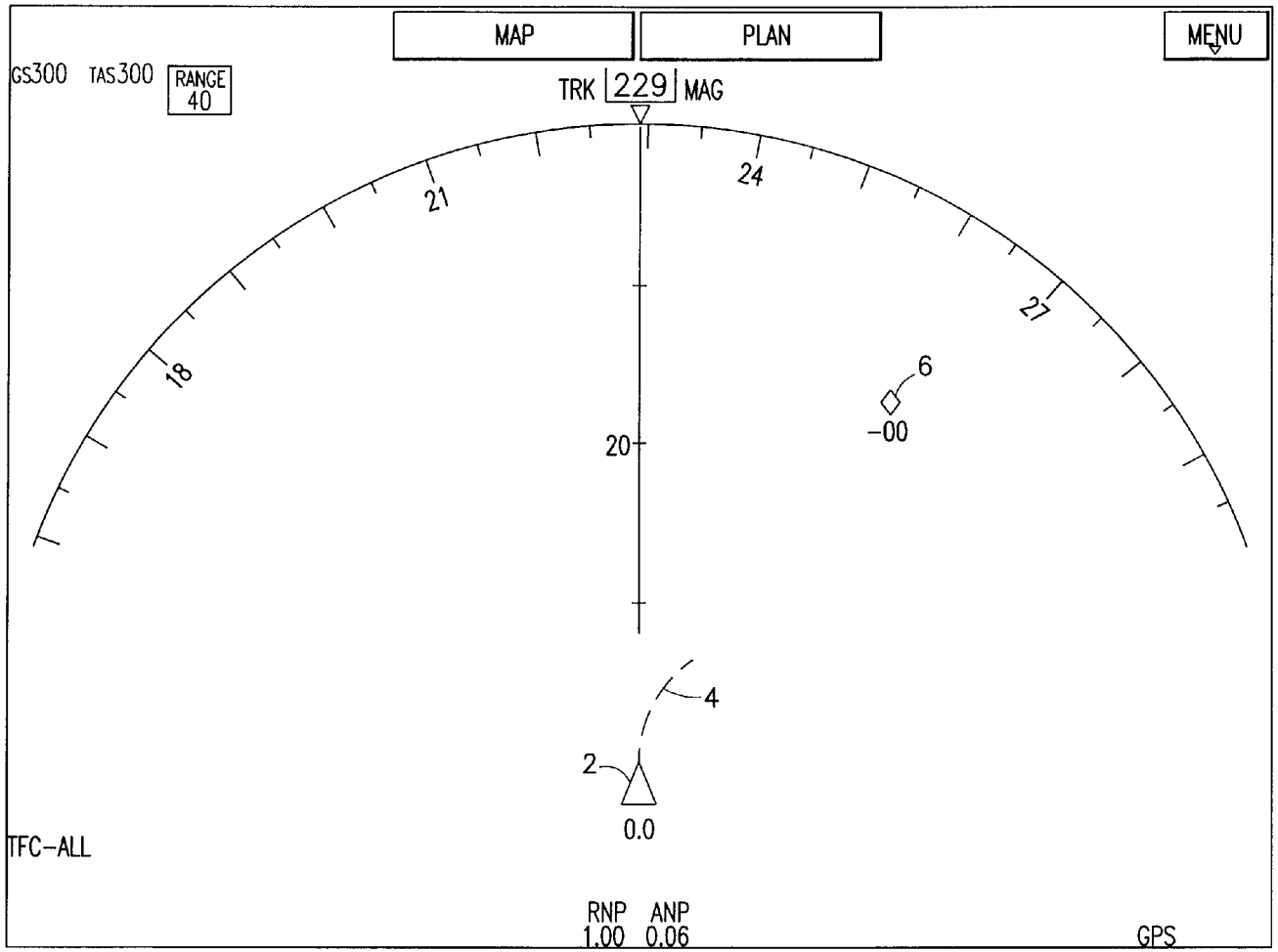
FIG. 1 is a diagram showing one implementation of a cockpit navigation display unit that is displaying symbols indicating the current positions of TCAS traffic (in this example, a single aircraft) relative to the current position of ownship in a frame of reference.

The screen of FIG. 1 also displays an icon 6 which represents a TCAS-equipped aircraft in the vicinity of ownship. The location of aircraft icon 6 relative to the location of ownship icon 2 generally indicates the current position of a TCAS-equipped aircraft relative to the current position of ownship. A person of ordinary skill in the art will recognize that movement of a particular aircraft icon relative to ownship icon 2 on the display screen indicates the movement of the corresponding other aircraft relative to ownship, not movement relative to an Earth-based frame of reference. For example, if ownship and the aircraft represented by icon 6 were traveling in parallel at the same speed, the position and orientation of aircraft icon 6 relative to the fixed position of ownship icon 2 would not change.

In accordance with the embodiment depicted in FIG. 1, the traffic display system onboard ownship comprises a plurality of computers or processors connected by a network or bus, hereinafter referred to as a "computer system". This computer system processes traffic data broadcast by other aircraft within the vicinity of ownship. When in a default mode, this computer system causes a traffic display unit (e.g., the cockpit navigation display) to display symbols indicating the current position, current heading/track and current trend of ownship and symbols indicating the relative current positions of other TCAS-equipped aircraft, as seen in the exemplary screen shot of FIG. 1. In particular, the computer system is also capable of generating a TA or RA in response to detection of a current conflict between the TCAS-equipped aircraft represented by aircraft icon 6 and ownship. The TA or RA may be a visible effect produced on the screen cockpit navigation display unit. The screenshot shown in FIG. 1 does not include any such warning because, in the particular scenario being depicted, no current conflict has been detected by the TCAS because the opposing aircraft is not within the specified airspace volume and it is not on a flight path that may cause it to collide with the ownship (based on the current position, current climb rate and current closure rate of the opposing TCAS-equipped aircraft). Nor does the screenshot shown in FIG. 1 indicate any future position of ownship.

Figure 2:
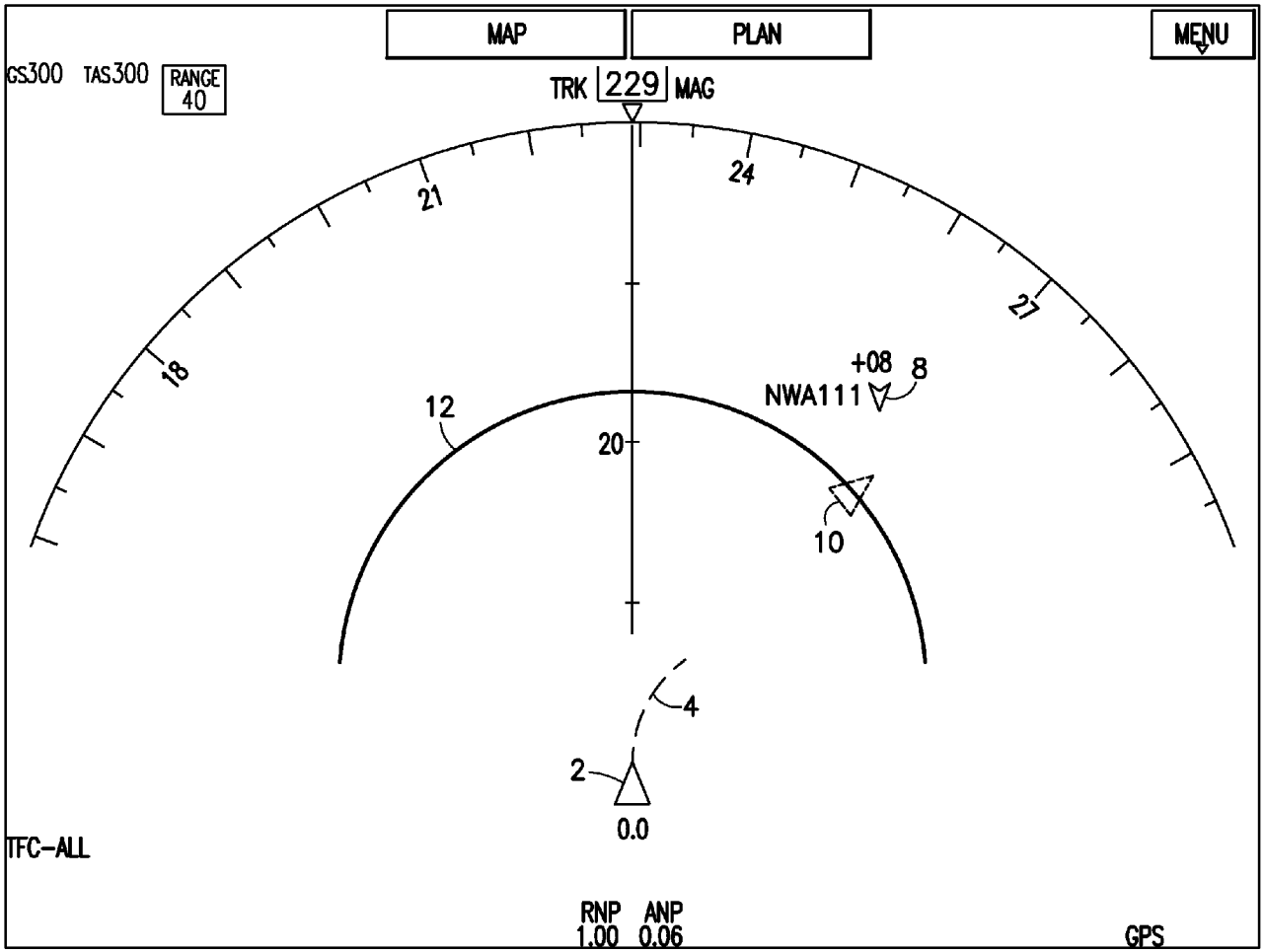
FIG. 2 is a diagram showing a cockpit navigation display unit that is displaying symbols indicating the current positions of ADS-B traffic (in this example, a single aircraft) relative to the current position and one future position of ownship in a frame of reference in accordance with one embodiment. The display shown in FIG. 2 further includes symbology comprising an ownship predictive position ring that indicates possible future positions of ownship were ownship to fly from its current position with its current heading/track at different possible bank angles for a specified time or distance.

In contrast, FIG. 2 shows a navigation display which, in addition to displaying an icon 2 representing the position and heading/track and a trend vector 4 of ownship relative to a frame of reference at a current time, also displays an icon 10 representing a predicted position and heading/track of ownship at a future time. Such a display is presented when the display system is in a "future ownship position" display mode. The future time may be after the expiration of a time interval (starting at the current time) of specified duration or after ownship has flown a specified distance from its current position. In a preferred embodiment, the display mode (e.g., "default" versus "future ownship position") can be selected by the flight crew, e.g., by operation of a switch.

In the future ownship position mode, the navigation display also displays symbols representing the identity, position and heading/track of any TCAS-, ADS-B- or TCAS/ADS-B-equipped aircraft within the display range of ownship. In the example shown in FIG. 2, the position and heading/track of a single TCAS/ADS-B-equipped aircraft is represented by an icon 8, its identity is indicated by the designation "NWA111", and its altitude relative to ownship's altitude is indicated by "+08" (i.e., Flight NWA111 is at an altitude 800 feet above ownship's altitude). In accordance with the embodiment depicted in FIG. 2, this method of traffic information display comprises: intermittently receiving data from Flight NWA111 during a period of time, the received data representing respective positions and groundspeeds of Flight NWA111 at successive times during the period of time; and the displaying symbology that indicates a current position of Flight NWA111 relative to the frame of reference.

In accordance with a further feature, the traffic information display method may further comprise: (a) calculating a future position of Flight NWA111 that would result were Flight NWA111 to continue to fly from its current position with its current heading/track, current climb rate and current groundspeed for the specified time or the time it will take for ownship to fly the specified distance; (b) determining whether there would be a conflict between the ownship and Flight NWA111 were they located at their respective calculated future positions; and (c) modifying the displayed traffic information to produce a first visible effect in response to a determination that there would be a conflict between ownship and Flight NWA111 were they to be located at their respective calculated future positions. In accordance with one implementation, this first visible effect is that the coloration of icon 10 in FIG. 2 changes to a different color such as amber, for example.

In accordance with yet another feature, the traffic information display method may further comprise: (a) determining whether a loss of separation between ownship and Flight NWA111 will occur were ownship and Flight NWA111 to continue on their respective predicted flight paths after reaching their respective calculated future positions; and (b) modifying the displayed traffic information to produce a second visible effect different than the first visible effect in response to a determination that a loss of separation will occur. In accordance with one implementation, this second visible effect is that the coloration of icon 10 in FIG. 2 changes to another color such as amber or red.

In accordance with one embodiment, a computer system onboard ownship acquires data representing a current position, current climb rate, current groundspeed, current heading/track, and current bank angle of ownship. The computer system then calculates a future position and a future heading/track of ownship that would result were the first aircraft to continue to fly from its current position at its current climb rate, current groundspeed and current bank angle for a specified time or distance. The symbol 2 is displayed to indicate the current position and current heading/track of ownship; the symbol 10 is displayed to indicate the future position and future heading/track of ownship. In addition, the computer system calculates possible future positions of ownship were ownship to fly from its current position with its current heading/track at different possible bank angles for the specified time or distance. Those possible future positions can be indicated on the display unit by displaying a predictive position ring 12, as seen in FIG. 2. In this implementation, the predictive position ring is a continuous curved line, but other symbology could be used (e.g., a dashed curved line). The predictive position ring 12 may intersect the future ownship position symbol 10, as shown in FIG. 2.

FIG. 2 presents flight crews with a predictive position ring 12 and a future position and future heading/track indicator (i.e., icon 10) as seen during maneuvering (climbing/descending and turning). The predictive position ring 12 provides the flight crew with an indication where the ownship may possibly be given its current speed and current heading/track, and taking into consideration the standard bank angles within the flight envelop of ownship's aircraft type. The arc predicts location based on standard bank angles that the ownship may perform; it will become narrower or widen depending on the speed and wind conditions to reflect the change in the course that the ownship will fly. The predictive position ring 12 represents the possible predicted positions of the ownship at a given interval from its current position. This interval can be time-based or distance-based and is variable based on pilot's preference.

The future position, heading/track indicator is shown as a dashed icon 10 representing ownship. The future position and future heading/track indicator preferably resides on the predictive position ring and indicates to the pilot where they can expect the ownship to be when it reaches the predictive position ring if they continue with their current heading/track, current groundspeed, current climb rate, and current bank angle, assuming that the given atmospheric conditions do not change. The future position and future heading/track indicator moves along the length of the predictive position ring in correlation with the turn rate of ownship. Further use of the future position and future heading/track indicator is a proactive alert for the pilot. It can show the pilot a possible traffic conflict if the pilot were to continue his/her current maneuvering. This indicator shows the pilot what may occur if current behavior continues. It gives the pilot the ability to avoid potentially dangerous maneuvers prior to initiation of the maneuver.

Another important function of the future position and future heading/track indicator is its use as a predictive conflict indicator, providing situational awareness to the flight crew. Using the position predicted by the future position and future heading/track indicator and applying TCAS and ADS-B information, the flight crew is given warnings of possible conflict at the predicted position. This augments the ownship's TCAS functionality to expand it beyond the immediate vicinity of the ownship's current location. The color of the future position and future heading/track indicator can be used to indicate to the flight crew potential problems in advance, such as a possible future Traffic Advisory or Resolution Advisory. Since the new position is only a possible prediction, it will be the color of the indicator that changes, not the color of the symbol representing the intruding traffic. As the flight crew makes changes to alter ownship's course, the future position and future heading/track indicator will alter its coloration to indicate no further conflicts. Given this new information ahead of its possible occurrence, this technology gives the flight crew a proactive alert that can be avoided rather than a reactive alert as with the current TCAS that only warns of conflicts when they have already started.

Persons skilled in the art will appreciate, however, that in alternative embodiments, the predictive conflict indicator may be a symbol distinct from the future position and future heading/track indicator. In accordance with further alternative embodiments, the predictive conflict indicator may comprise an audible effect in addition to or instead of a visible effect.

Figure 3:
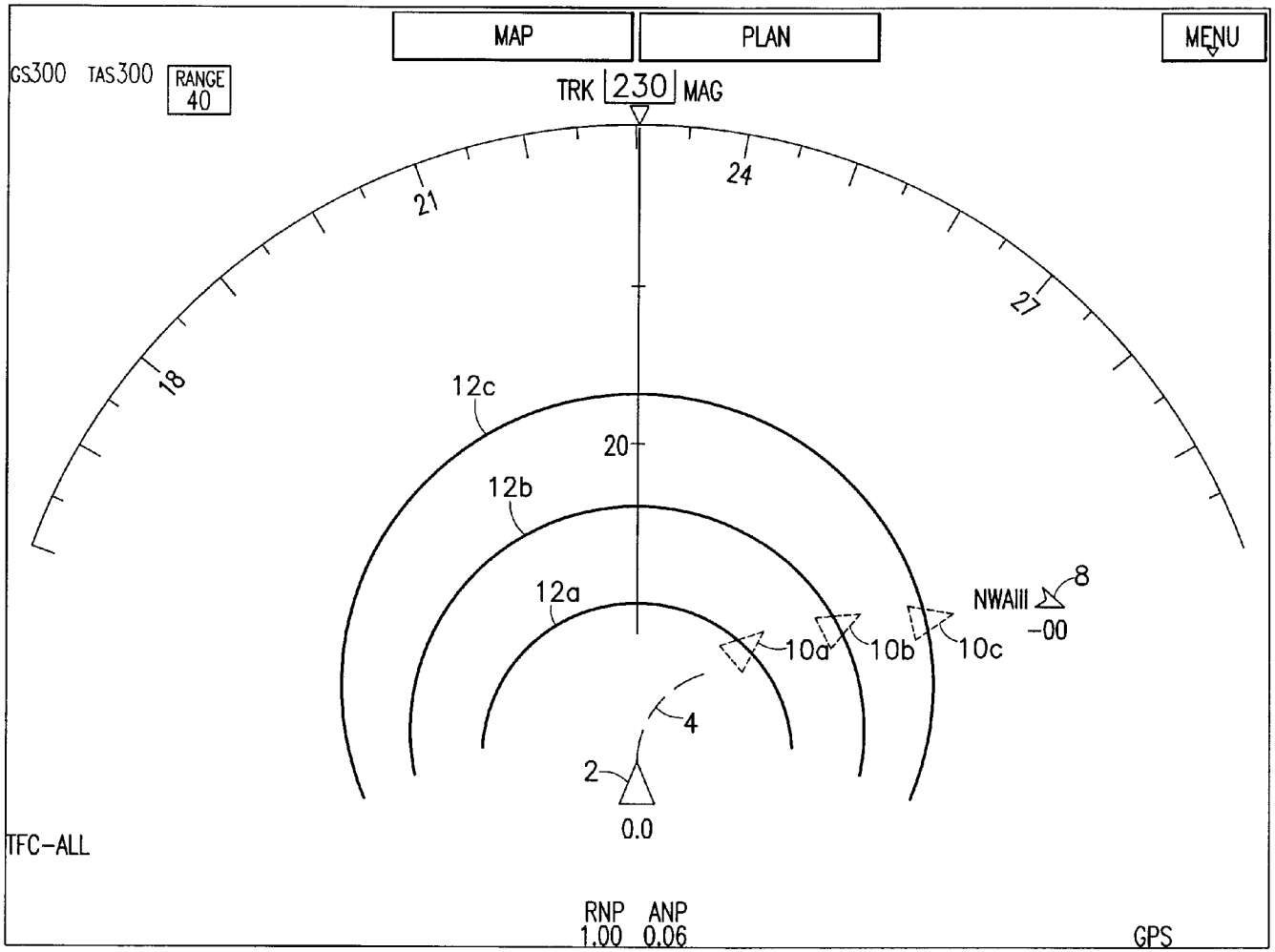
FIG. 3 is a diagram showing a cockpit navigation display unit that is displaying symbols indicating the current positions of ADS-B traffic (in this example, a single aircraft) relative to the current position and three future positions of ownship in a frame of reference in accordance with another embodiment. The display shown in FIG. 3 further includes symbology comprising three ownship predictive position rings that respectively indicate three possible future positions of ownship were ownship to fly from its current position with its current heading/track at different possible bank angles for different specified times or distances.

The same principles of operation apply to the navigation display shown in FIG. 3. However, in accordance with this embodiment, multiple predictive position rings 12*a*, 12*b*, 12*c* and multiple future ownship position icons 10*a*, 10*b*, 10*c* are displayed, each predictive position ring intersecting a respective future ownship position icon. The progressive inner predictive position rings 12*a* and 12*b* are an extension of the standard predictive position ring 12*c*. The inner rings provide flight crews with a set of rings spaced apart by a pilot-selectable interval. The inner rings give a progressive indication of the heading/track and position of the ownship on its flight path to the positions corresponding to predictive position ring 12*c*. This augments predictive position ring 12*c* by giving a further sense of situational awareness of where the ownship is heading and what it will do prior to getting there. This tool aids in the planning/positioning of the ownship at a desired future location and gives a view of its progression towards that goal.

More specifically, the first predictive position ring 12*a* represents possible future positions of ownship were ownship to fly from its current position with its current heading/track at different possible bank angles for a first specified time or distance. The second predictive position ring 12*b* represents possible future positions of ownship were ownship to fly from its current position with its current heading/track at different possible bank angles for a second specified time or distance (greater than the first specified time or distance). The third predictive position ring 12*c* represents possible future positions of ownship were ownship to fly from its current position with its current heading/track at different possible bank angles for a third specified time or distance (greater than the second specified time or distance). Similarly, the icons 10*a*, 10*b*, 10*c* represent the respective future positions and headings/tracks of ownship that would result were ownship to continue to fly from its current position at its current climb rate, current groundspeed and current bank angle for the first, second and third specified times or distances, respectively. The coloration of any one of icons 10*a*, 10*b*, 10*c* can be changed to reflect any conflict or loss of separation with Flight NWA111 as previously described.

With the view shown in FIG. 3 enabled, the pilot is given a progressive view of where ownship will be and its predicted heading/track at specific time intervals in the future. This is a planning tool that can be used to accurately position the ownship into some heading at a given future position.

Figure 4:
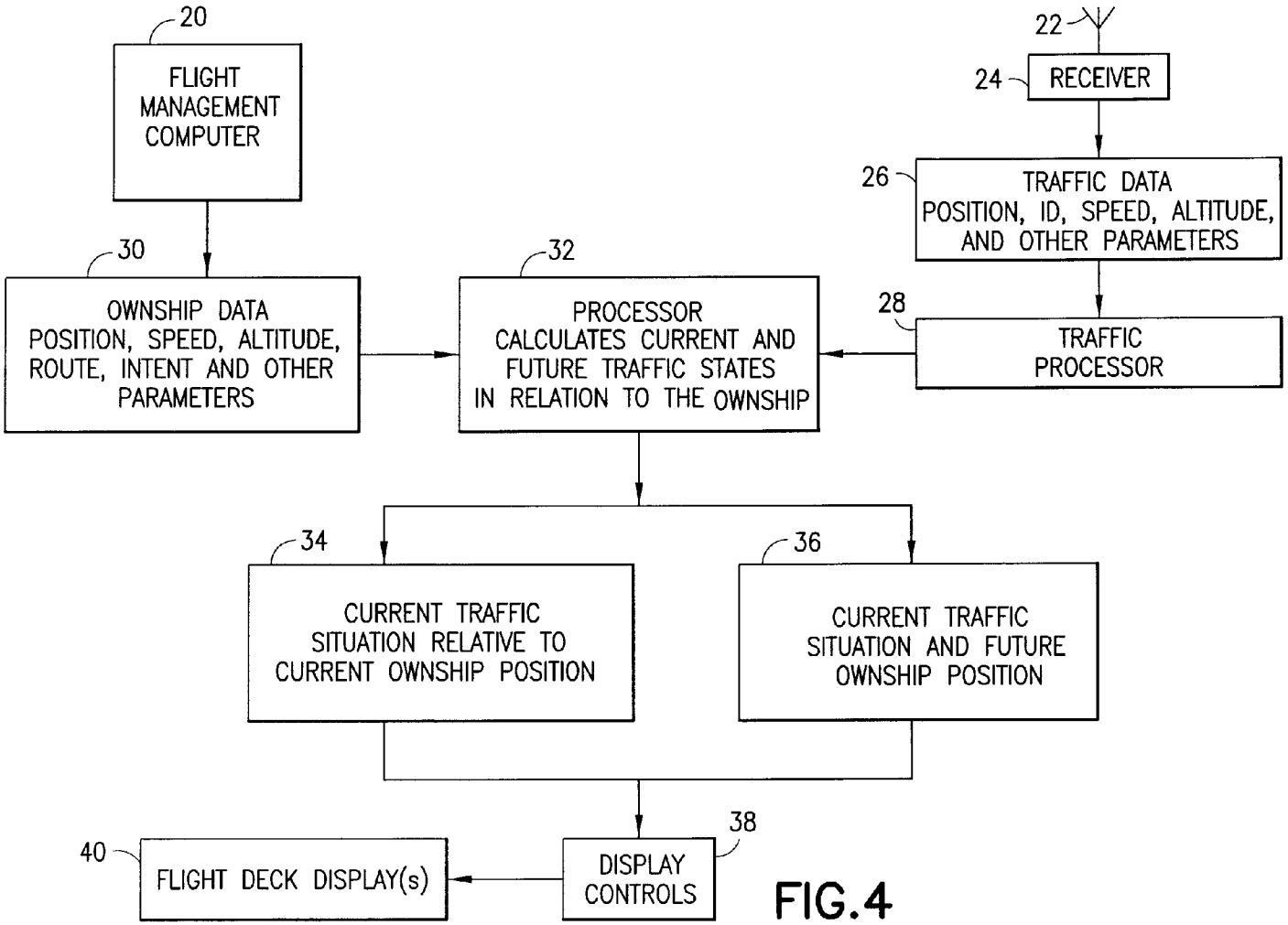
FIG. 4 is a hybrid block diagram/flowchart showing a system and a method in accordance with one embodiment for displaying (e.g., on a navigation display) symbols representing current positions of ownship and surrounding air traffic as well as one or more future positions of ownship, displaying a first alert in the event of a current conflict between ownship and another aircraft; and displaying a second alert in the event that a future conflict between ownship and another aircraft is predicted.

FIG. 4 shows a system for displaying traffic symbols on one or more flight deck displays 40 based on traffic information broadcast by other aircraft. The system has an antenna 22 for converting traffic data signals broadcast by aircraft (e.g., TCAS and ADS-B traffic information) located within range of ownship into electrical signals, which are received by a receiver 24. The receiver outputs broadcast traffic data 26 to a traffic processor 28. The broadcast traffic data 26 includes the following information for each broadcasting ADS-B-equipped aircraft: identity, longitude and latitude, altitude, groundspeed, and other parameters, which information is broadcast every second. All of the received traffic data is processed by a traffic processor 28, which filters and stores the traffic data and then continually sends signals representing that traffic data to a conflict processor 32. The conflict processor 32 onboard ownship is programmed to calculate the heading/track and climb rate of the other aircraft based on the stream of position information (i.e., latitude, longitude and altitude) received from that aircraft.

The conflict processor 32 also receives ownship data 30 from a flight management system 20 onboard ownship. This ownship data may include information concerning the longitude, latitude, heading and track, groundspeed, altitude, climb rate, route, maneuver occurrence, and other parameters. Based on the available traffic information, the conflict processor 32 calculates the current traffic states of other aircraft relative to the current traffic state of ownship (block 34 in FIG. 4). In a default display mode, the conflict processor 32 converts the results of the calculations of current traffic states into the proper format for display as a page of graphical data on the traffic display screen (see, e.g., FIG. 1). In a future ownship position display mode, the conflict processor 32 calculates the future traffic states of other aircraft relative to the future traffic states of ownship. Based on the future traffic states of ownship, the conflict processor calculates the respective positions of at least one predictive position ring and corresponding future position/heading indicator(s) (block 36 in FIG. 4). The conflict processor 32 converts the results of those calculations into the proper format for display as a page of graphical data on the traffic display screen that further includes at least one predictive position ring and corresponding future position and future heading/track indicator(s) (see, e.g., FIG. 2 or 3). The flight crew is provided with an interface (not shown in FIG. 4), e.g., a rotatable knob or buttons, for selecting the display mode. The page of graphical data for the selected display mode is inputted to a display controller 38, which controls what page is displayed on the flight deck display(s) 40 as a function of the flight crew selection.

The conflict processor 32 is programmed to execute algorithms that determine the extrapolated positions and other parameters of ownship and other aircraft within ownship's display range. The extrapolated position of an aircraft can be readily calculated based on information such as the current position, heading and track, groundspeed, altitude, climb rate, bank angle and maneuver of the aircraft, its rate of change of heading, and the wind speed and direction, using well-known equations of motion and geometric and trigonometric relationships. For example, the conflict processor 32 may perform the following operations: (a) calculate a future position and a future heading/track of ownship that would result were ownship to continue to fly from its current position at its current climb rate, current groundspeed and current bank angle for a specified time or distance; (b) calculate possible future positions of ownship were ownship to fly from its current position on its current heading/track at different possible bank angles for the specified time or distance; and (c) calculate a future position of another aircraft that would result were that other aircraft to continue to fly from its current position with its current heading, current climb rate and current groundspeed for the specified time or the time it will take for ownship to fly the specified distance.

The conflict processor 32 is further programmed to execute a conflict detection algorithm that uses the calculated future position and future heading/track information for ownship and another aircraft within ownship's display range. One embodiment of that conflict detection algorithm includes the following operations: (a) determine whether there would be a conflict between ownship and the other aircraft were they located at their respective calculated future positions; and (b) determine whether a loss of separation between the first and second aircraft will occur were they to continue on their respective predicted flight paths after reaching their respective calculated future positions.

In particular, the conflict processor 32 may input calculated future positions (instead of current positions) of ownship and another aircraft into a TCAS conflict detection algorithm to determine whether a future conflict is possible (i.e., will the other aircraft at its future position be located within a protected volume of airspace that would surround the future position of ownship). In accordance with one embodiment, this conflict detection algorithm comprises the following operations: (a) calculating a future range of the second aircraft from the first aircraft based on the future positions of the first and second aircraft; (b) comparing the calculated future range to a specified range threshold; (c) calculating a future difference between the altitudes of the future positions of the first and second aircraft; and (d) comparing the calculated future difference to a specified altitude difference threshold. In the event of a conflict, the conflict processor will generate a Traffic Advisory.

If the other aircraft, at its future position, will be within the protected volume of airspace surrounding the future ownship position, then the conflict processor can execute a loss of separation detection algorithm that utilizes the heading/climb rate/closure rate of the other aircraft to determine whether a loss of separation between ownship and the other aircraft will occur. If the conflict processor determines that a loss of separation will occur in the future, the conflict processor immediately generates a Resolution Advisory. Algorithms for detecting a loss of separation between two aircraft are well known. One such algorithm involves computing the separation between the flight paths of ownship and another aircraft for each future position of ownship along its flight path and then comparing successive separation values to a specified threshold. When the calculated future separation falls below the specified threshold, then the conflict processor can predict that a loss of separation will occur at the time when ownship will arrive at its future position corresponding to the below-threshold future separation.

In accordance with the embodiment shown in FIG. 4, the conflict processor 32 also generates display data. Alternatively, this function could be performed by a separate display processor. The generation of display data of the types depicted in FIGS. 2 and 3 involves the following operations: (a) convert the current position and current heading/track of ownship into first display data representing a first symbol that will indicate the current position and current heading/track of ownship relative to a frame of reference when displayed on the display screen 40; (b) convert the calculated future position and future heading/track of ownship into second display data representing a second symbol that will indicate the future position and future heading/track of ownship relative to the frame of reference when displayed on the display screen; (c) convert the calculated possible future positions of ownship into third display data representing a curved line that intersects the second symbol; and (d) convert position and groundspeed data of the other aircraft received during the period of time into third display data representing a third symbol that indicates a current position of the other aircraft relative to the frame of reference.

While the invention has been described with reference to various embodiments, it will be understood by those skilled in the art that various changes may be made and equivalents may be substituted for elements thereof without departing from the scope of the invention. In addition, many modifications may be made to adapt the teachings herein to a particular situation without departing from the scope thereof. Therefore it is intended that the claims not be limited to the particular embodiments disclosed.

As used in the claims, the term "computer system" should be construed broadly to encompass a system having at least one computer or processor, and which may have multiple computers or processors that communicate through a network or bus. As used in the preceding sentence, the terms "computer" and "processor" both refer to devices having a processing unit (e.g., a central processing unit) and some form of memory (i.e., computer-readable medium) for storing a program which is readable by the processing unit.

As used in the claims, the term "curved line" should be construed broadly to encompass at least the following: curved continuous lines, and series of spaced line segments or points arranged along a curved path.

The method claims set forth hereinafter should not be construed to require that the steps recited therein be performed in alphabetical order or in the order in which they are recited. Nor should they be construed to exclude any portions of two or more steps being performed concurrently or alternatingly.

The invention claimed is:

1. A method for displaying traffic information on a traffic display unit onboard a first aircraft, comprising:

acquiring data representing a current position, current climb rate, current groundspeed, current heading, current track, and current bank angle of the first aircraft;

calculating a future position and a future heading/track of the first aircraft that would result were the first aircraft to continue to fly from the current position of the first aircraft at the current climb rate, current groundspeed and current bank angle of the first aircraft for a specified time or distance;

displaying a first symbol that indicates the current position and current heading/track of the first aircraft relative to a frame of reference; and displaying a second symbol that indicates the future position and future heading/track of the first aircraft relative to the frame of reference.

2. The method as recited in claim 1, further comprising:

displaying a curved line that indicates possible future positions of the first aircraft were the first aircraft to fly from the current position of the first aircraft with the current heading/track of the first aircraft at different possible bank angles for the specified time or distance.

3. The method as recited in claim 2, wherein said curved line intersects said second symbol.

4. The method as recited in claim 1, further comprising:

intermittently receiving data from a second aircraft during a period of time, said received data representing respective positions and groundspeeds of the second aircraft at successive times during said period of time; and displaying a third symbol that indicates a current position of the second aircraft relative to the frame of reference.

5. The method as recited in claim 4, further comprising:

(a) calculating a future position of the second aircraft that would result were the second aircraft to continue to fly from the current position of the second aircraft with the current heading/track, current climb rate and current groundspeed of the second aircraft for the specified time or the time it will take for the first aircraft to fly the specified distance;

(b) determining whether there would be a conflict between the first and second aircraft were the first and second aircraft located at said respective calculated future positions; and (c) modifying the displayed traffic information to produce a first visible effect in response to a determination that there would be a conflict between the first and second aircraft if they were located at said respective calculated future positions.

6. The method as recited in claim 5, wherein step (b) comprises:

calculating a future range of the second aircraft from the first aircraft based on said future positions of the first and second aircraft; and comparing said calculated future range to a specified range threshold.

7. The method as recited in claim 6, wherein step (b) further comprises:

calculating a future difference between the altitudes of said future positions of the first and second aircraft; and comparing said calculated future difference to a specified altitude difference threshold.

8. The method as recited in claim 5, further comprising:

determining whether a loss of separation between the first and second aircraft will occur were the first and second aircraft to continue on their respective predicted flight paths after reaching said respective calculated future positions; and modifying the displayed traffic information to produce a second visible effect different than said first visible effect in response to a determination that a loss of separation will occur.

9. A system for displaying traffic information onboard a first aircraft, comprising a display screen and a computer system programmed to perform the following operations:

acquire data representing a current position, current climb rate, current groundspeed, current heading, current track, and current bank angle of the first aircraft;

calculate a future position and a future heading/track of the first aircraft that would result were the first aircraft to continue to fly from the current position of the first aircraft at the current climb rate, current groundspeed and current bank angle of the first aircraft for a specified time or distance;

convert the current position and current heading/track of the first aircraft into first display data representing a first symbol that will indicate the current position and current heading/track of the first aircraft relative to a frame of reference when displayed on said display screen;

convert, the calculated future position and future heading/track of the first aircraft into second display data representing a second symbol that will indicate the future position and future heading/track of the first aircraft relative to the frame of reference when displayed on said display screen; and send said first and second display data to said display screen, wherein said display screen will display said first and a second symbol in response to receipt of said first and second display data.

10. The system as recited in claim 9, wherein said computer system is further programmed to perform the following operations:

calculate possible future positions of the first aircraft were the first aircraft to fly from the current position of the first aircraft on the current heading/track of the first aircraft at different possible bank angles for the specified time or distance;

convert the calculated possible future positions of the first aircraft into third display data representing a curved line; and send said third display data to said display screen, wherein said display screen displays said curved line in response to receipt of said third display data.

11. The system as recited in claim 10, wherein said curved line intersects said second symbol.

12. The system as recited in claim 9, further comprising an antenna capable of intermittently receiving position and groundspeed data from a second aircraft during a period of time, wherein said computer system is further programmed to perform the following operations:

convert position and groundspeed data of the second aircraft received during said period of time into third display data representing a third symbol that indicates a current position of the second aircraft relative to the frame of reference; and send said third display data to said display screen, wherein said display screen displays said third symbol in response to receipt of said third display data.

13. The system as recited in claim 12, wherein said computer system is further programmed to perform the following operations:

(a) calculate a future position of the second aircraft that would result were the second aircraft to continue to fly from the current position of the second aircraft with the current heading/track, current climb rate and current groundspeed of the second aircraft for the specified time or the time it will take for the first aircraft to fly the specified distance;

(b) determine whether there would be a conflict between the first and second aircraft were the first and second aircraft located at said respective calculated future positions; and (c) send first visible alert display data to said display screen in response to a determination that there would be a conflict between the first and second aircraft if they were located at said respective calculated future positions, wherein said display screen produces a first visible effect in response to receipt of said first visible alert display data.

14. The system as recited in claim 13, wherein said computer system is further programmed to perform the following operations:

determine whether a loss of separation between the first and second aircraft will occur were the first and second aircraft to continue on their respective predicted flight paths after reaching said respective calculated future positions; and send second visible alert display data to said display screen in response to a determination that a loss of separation will occur, wherein said display screen produces a second visible effect different than said first visible effect in response to receipt of said second visible alert display data.

15. A method for generating a traffic alert onboard a first aircraft, comprising, acquiring data representing a current position, current climb rate, current groundspeed, current heading, current track, and current bank angle of the first aircraft;

calculating a future position and a future heading/track of the first aircraft that would result were the first aircraft to continue to fly from the current position of the first aircraft at the current climb rate, current groundspeed and current bank angle of the first aircraft for a specified time or distance;

intermittently receiving data from a second aircraft during a period of time preceding a current time, said received data representing respective positions and groundspeeds of the second aircraft at successive times during said period of time;

calculating a future position of the second aircraft that would result were the second aircraft to continue to fly from the current position of the second aircraft with the current heading/track, current climb rate and current groundspeed of the second aircraft for the specified time or the time it will take for the first aircraft to fly the specified distance; and determining whether there would be a conflict between the first and second aircraft were the first and second aircraft located at said respective calculated future positions.

16. The method as recited in claim 15, further comprising producing a first visible or audible effect in response to a determination that there would be a conflict between the first and second aircraft if they were located at said respective calculated future positions.

17. The method as recited in claim 16, wherein said determining step comprises:

calculating a future range of the second aircraft from the first aircraft based on said future positions of the first and second aircraft;

comparing said calculated future range to a specified range threshold;

calculating a future difference between the altitudes of said future positions of the first and second aircraft; and comparing said calculated future difference to a specified altitude difference threshold, wherein, said producing step is performed in response to the following conditions being satisfied:

(i) said calculated future range is less than said specified range threshold; and (ii) said calculated future difference is less than said specified altitude difference threshold.

18. The method as recited in claim 15, further comprising determining whether a loss of separation between the first and second aircraft will occur were the first and second aircraft to continue on their respective predicted flight paths after reaching said respective calculated future positions.

19. The method as recited in claim 18, further comprising:

producing a first visible or audible effect in response to a determination that there would be a conflict between the first and second aircraft if they were located at said respective calculated future positions; and producing a second visible or audible effect in response to a determination that a loss of separation will occur.

20. A system for generating a traffic alert onboard a first aircraft, comprising:

a source of data representing the position, climb rate, heading, track, groundspeed and bank angle of the first aircraft at successive times during a time period;

an antenna capable of receiving TCAS messages and ADS-B messages from other aircraft during said time period;

a traffic processor programmed to derive first data representing the ranges, altitudes and bearings of other aircraft from received TCAS messages and further programmed to derive second data representing the positions and groundspeeds of other aircraft from received ADS-B messages;

a warning device capable of producing a visible or audible alert in response to an alert activation command; and a conflict processor programmed to perform the following operations:

calculate a future position and a future heading/track of the first aircraft that would result were the first aircraft to continue to fly from the current position at the current climb rate, current groundspeed and current bank angle of the first aircraft for a specified time or distance;

calculate a future position of a second aircraft that would result were the second aircraft to continue to fly from the current position of the second aircraft with the current heading/track and at the current climb rate and current groundspeed of the second aircraft for the specified time or the time it will take for the first aircraft to fly the specified distance;

detect whether the second aircraft has intruded into a first specified volume of airspace surrounding said current position of the first aircraft;

determine whether the second aircraft will intrude into a second specified volume of airspace surrounding said future position of the first aircraft;

send a first alert activation command to said warning device in response to detection of an intrusion by the second aircraft into said first specified volume of space at a current time; and send a second alert activation command to said warning device in response to a determination that the second aircraft will intrude into said second specified volume at a future time.

21. The system as recited in claim 20, wherein said warning device comprises a display screen, and said conflict processor is further programmed to perform the following operations:

convert the current position and current heading/track of the first aircraft into first display data representing a first symbol that will indicate the current position and current heading/track of the first aircraft relative to a frame of reference when displayed on said display screen;

convert the calculated future position and future heading/track of the first aircraft into second display data representing a second symbol that will indicate the future position and future heading/track of the first aircraft relative to the frame of reference when displayed on said display screen; and send said first and second display data to said display screen, wherein said display screen will display said first and second symbols in response to receipt of said first and second display data.

22. The system as recited in claim 20, wherein said conflict processor is further programmed to determine whether a loss of separation between the first and second aircraft will occur were the first and second aircraft to continue on their respective predicted flight paths after reaching said respective calculated future positions.

* * * * *